US007887645B1

(12) United States Patent
Schoen et al.

(10) Patent No.: US 7,887,645 B1
(45) Date of Patent: Feb. 15, 2011

(54) HIGH PERMEABILITY GRAIN ORIENTED ELECTRICAL STEEL

(75) Inventors: Jerry W. Schoen, Middletown, OH (US); Norris A. Dahlstrom, Liberty Township, OH (US); Robert J. Comstock, Jr., Trenton, OH (US)

(73) Assignee: AK Steel Properties, Inc., West Chester, OH (US)

( * ) Notice: Subject to any disclaimer, the term of this patent is extended or adjusted under 35 U.S.C. 154(b) by 0 days.

(21) Appl. No.: 09/847,236

(22) Filed: May 2, 2001

(51) Int. Cl.
*H01F 1/147* (2006.01)
*H01F 1/18* (2006.01)

(52) U.S. Cl. ..... 148/111; 148/308

(58) Field of Classification Search ..... 148/110–113
See application file for complete search history.

(56) References Cited

U.S. PATENT DOCUMENTS

| | | | | |
|---|---|---|---|---|
| 4,456,812 | A | 6/1984 | Neiheisel | |
| 5,288,736 | A * | 2/1994 | Schoen et al. | 148/111 |
| 5,421,911 | A * | 6/1995 | Schoen | 148/111 |
| 5,643,370 | A * | 7/1997 | Huppi | 148/111 |
| 5,702,539 | A * | 12/1997 | Schoen et al. | 148/111 |
| 5,779,819 | A | 7/1998 | Huppi | |
| 7,377,986 | B2 | 5/2008 | Schoen et al. | |

FOREIGN PATENT DOCUMENTS

| | | |
|---|---|---|
| JP | 93078743 | 3/1993 |
| JP | 97049022 | 2/1997 |
| JP | 9804297 | 2/1998 |
| JP | 10102150 | 4/1998 |

OTHER PUBLICATIONS

International Search Report dated Oct. 7, 2002 for Application No. PCT/US02/12623.
International Preliminary Examination Report dated Jun. 5, 2003 for Application No. PCT/US02/12623.
Written Opinion dated Dec. 16, 2002 for Application No. PCT/US02/12623.

* cited by examiner

*Primary Examiner*—John P Sheehan
(74) *Attorney, Agent, or Firm*—Frost Brown Todd LLC

(57) ABSTRACT

The present invention provides a method of producing a high permeability grain oriented electrical steel having excellent mechanical and magnetic properties. A hot band having a thickness of about 1.5 to about 4.0 mm has a chemistry comprising about 2.5 to about 4.5% silicon, about 0.1 to about 1.2% chromium, about 0.02 to about 0.08% carbon, about 0.01 to about 0.05% aluminum, up to about 0.1% sulfur, up to about 0.14% selenium, about 0.03 to about 0.15% manganese, up to about 0.2% tin, up to about 1% copper, and balance being essentially iron and residual elements, all percentages by weight. The band has a volume resistivity of at least about 45 μΩ-cm, an austenite volume fraction ($\gamma_{1150° C.}$) of at least 20% and the strip has an isomorphic layer thickness of at least about 2% of the total thickness on at least one surface of the hot processed band. The band is rapidly cooled after the anneal prior to cold rolling at a rate of at least 30° C./second from 875-950° C. to a temperature below 400° C. The band is cold reduced in one or more stages with a final reduction of at least 80%, annealed, decarburized and coated with an annealing separator on at least one side. A final annealing provides stable secondary grain growth and a permeability measured at 796 A/m of at least 1840.

20 Claims, 2 Drawing Sheets

*FIG. 1 - Permeability at 796 A/m versus Final Thickness Using Cooling Rate ≤ 15°C/sec*
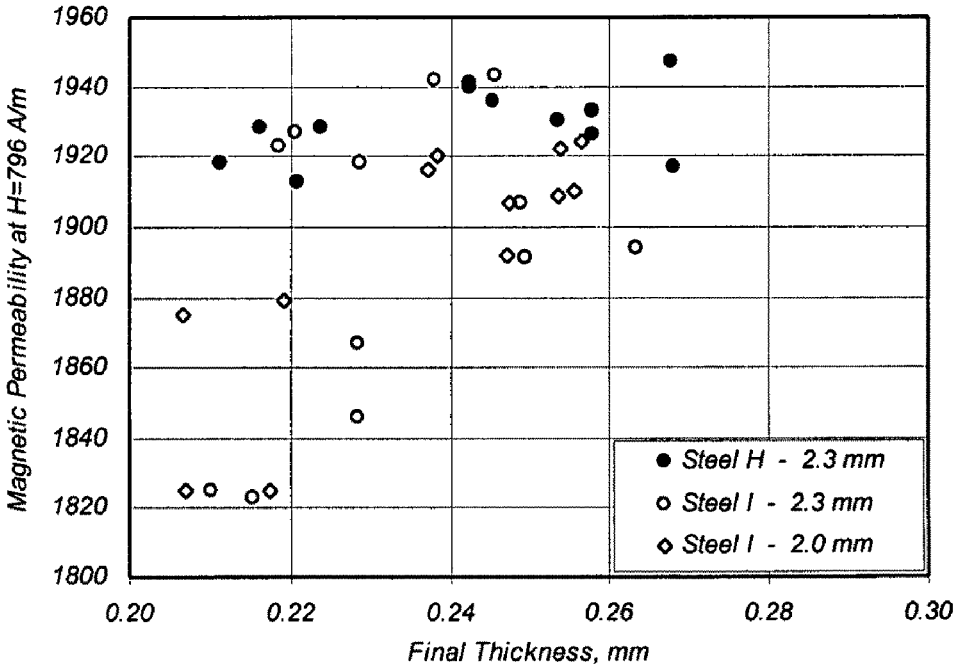
*FIG. 2 - Permeability at 796 A/m versus Final Thickness Using Cooling Rate ≥ 50°C/sec*
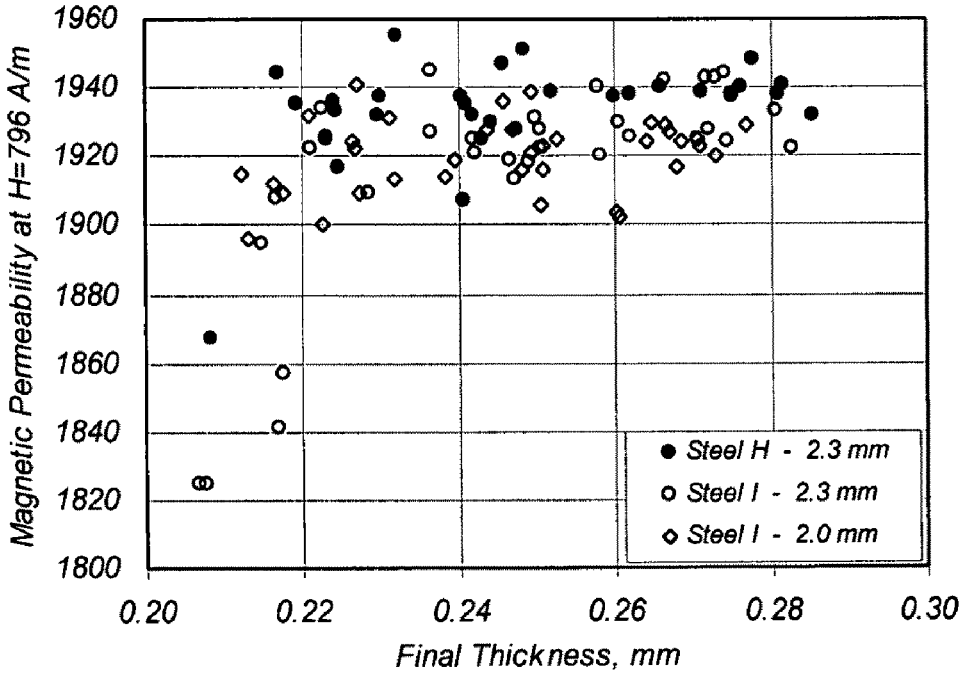

FIG. 3
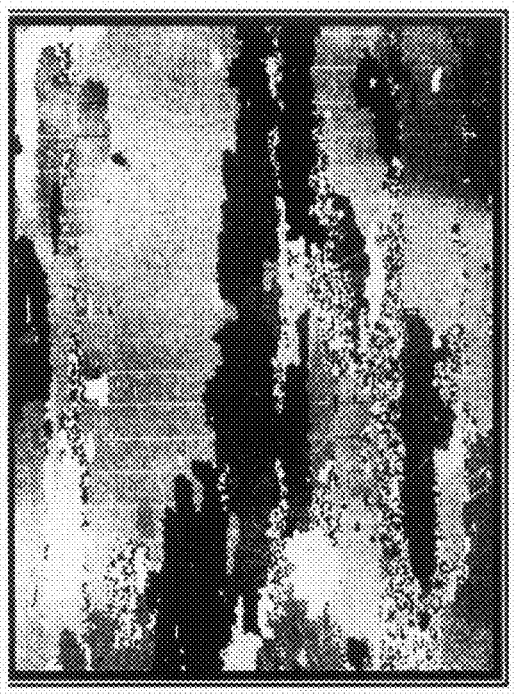
Cooled at a rate of less than 15°C per second.
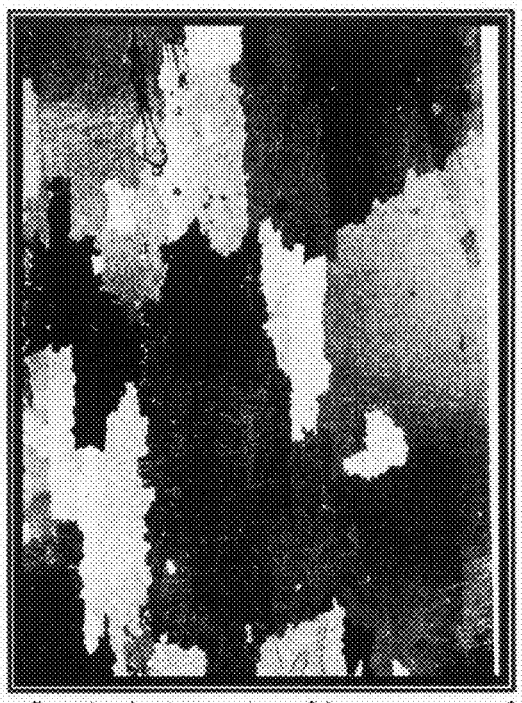
Cooled at a rate of in excess of than 50°C per second.

HIGH PERMEABILITY GRAIN ORIENTED ELECTRICAL STEEL

BACKGROUND OF THE INVENTION

The present invention relates to a method of producing a high permeability grain oriented electrical steel from a hot processed strip, or band, comprising about 2.0 to about 4.5% silicon, about 0.1 to about 1.2% chromium, at least about 0.01% carbon and about 0.01 to about 0.05% aluminum. The steel strip will typically have a volume resistivity of at least 45 μΩ-cm, an austenite volume fraction ($\gamma_{1150° C.}$) of at least about 20% and an isomorphic layer thickness of at least about 2% of the total thickness of the strip on at least one surface prior to final cold rolling.

Electrical steels are broadly characterized into two classes. Non-oriented electrical steels are engineered to provide uniform magnetic properties in all directions. These steels are comprised of iron, silicon and aluminum to impart higher volume resistivity to the steel sheet and thereby lower the core loss. Non-oriented electrical steels may also contain manganese, phosphorus and other elements commonly known in the art to provide higher volume resistivity and lower core losses created during magnetization.

Grain oriented electrical steels are engineered to provide high volume resistivity with highly directional magnetic properties owing to the development of a preferential grain orientation. These steels are differentiated by the grain growth inhibitors used, the process routing employed and the quality of the grain orientation achieved as indicated by the magnetic permeability measured at 796 A/m. Regular (or conventional) grain oriented electrical steels have a permeability of at least 1780 whereas high permeability grain oriented electrical steels have a permeability of at least about 1840 and typically greater than 1880. Typically, the volume resistivity of commercially produced grain oriented electrical steels range from 45-55 μΩ-cm which is provided by the addition of from 2.95% to 3.45% silicon with iron and other impurities incidental to the method of steelmaking. The processing steps of major importance may include melting, slab or strip casting, slab reheating, hot rolling, annealing and cold rolling.

To achieve the desired magnetic properties in a grain oriented electrical steel, a cube-on-edge grain orientation is developed in the final high temperature anneal of the steel by a process commonly referred to in the art as secondary grain growth. Secondary grain growth is a process by which small cube-on-edge oriented grains preferentially grow to consume grains of other orientations. Vigorous secondary grain growth is primarily dependent on two factors. First, the grain structure and crystalline texture of the steel, particularly the surface and near-surface layers of the steel surface, must provide conditions appropriate for secondary grain growth. Second, a grain growth inhibitor dispersion, such as aluminum nitride, manganese sulfide, manganese selenide or the like, capable of restraining primary grain growth must be provided to restrain primary grain growth until secondary grain growth is complete.

The composition and processing of the steel influence the morphology of the grain growth inhibitor, microstructure and crystalline texture. The typical methods for the production of high permeability grain oriented electrical steels rely on aluminum nitride precipitates or aluminum nitride precipitates in combination with manganese sulfides, and/or manganese selenides for primary grain growth inhibition. Other precipitates may be included in combination with aluminum nitrides, such as copper and the like. The characteristics of the surface and near-surface layers of the steel surface in the hot processed band are important to the development of a high permeability grain oriented electrical steel. This surface region, depleted of carbon and substantially free of austenite and its decomposition products provides a substantially single phase, or isomorphic, ferritic microstructure, and is referred to in the art as the surface decarburized layer. Alternatively, it may be defined as the boundary between the isomorphic surface layers and the polymorphic (mixed phases of ferrite and austenite or its decomposition products) interior layer, such as shear band and the like. Cube-on-edge secondary grain nuclei with the highest likelihood of sustaining vigorous growth and producing a high degree of cube-on-edge grain orientation are contained within the isomorphic layer or, alternatively, near the boundary between the isomorphic surface layers and polymorphic interior layer.

In the development of grain oriented electrical steels with lower core loss, higher volume resistivity steels have been explored. Typically, higher silicon levels are used which require higher levels of austenite-forming elements to maintain a proper proportion, or phase balance, between the austenite and ferrite phases. Carbon is the most common addition to increase the level of austenite.

The use of higher levels of silicon and carbon for the production of high permeability grain oriented steels has caused many manufacturing problems, increasing both the difficulty and cost of production. Higher levels of silicon and carbon lower the solidus temperature which has an important influence on the formation of defects which may occur during high temperature processing such as solidification, slab or strip casting, slab or strip reheating and/or hot rolling. The use of higher levels of silicon and, to a lesser degree, carbon, have reduced physical ductility and increased brittleness, making the steel more difficult and costly to process. Higher levels of silicon, and to a lesser extent, carbon, contribute to less stable secondary grain growth. As the level of silicon increases, the thermodynamic activity of nitrogen increases and the solubility product of the aluminum nitride grain growth inhibitor is reduced. Higher solutionizing temperatures are then required which make processes such as hot band annealing less productive and more costly. Higher levels of carbon, and silicon increase the time required for carbon removal, making decarburization annealing more difficult and costly.

Given the above mentioned circumstances, there has remained a need for an improved method for the production of high permeability grain oriented electrical steels having high volume resistivity and improved processing characteristics. In the method of the present invention, the proper proportions of silicon, chromium and carbon are provided for vigorous and stable secondary grain growth and excellent magnetic quality. The method of the present invention also improves the decarburization process.

BRIEF SUMMARY OF THE INVENTION

A high permeability grain oriented electrical steel is produced from a silicon steel composition with chromium. The grain growth inhibitors are primarily aluminum nitride or aluminum nitride in combination with one or more of manganese sulfide/selenide or other inhibitors. The steel has excellent magnetic properties with a magnetic permeability measured at 796 A/m of at least 1840. The steel has improved processability and productivity, particularly in decarburization annealing where the time required for carbon removal is significantly reduced.

A hot processed band is provided having a composition comprising about 2.0 to about 4.5% silicon, about 0.1 to about 1.2% chromium, greater than about 0.01% carbon, about 0.01 to about 0.05% aluminum, and balance being essentially iron and residual elements, all percentages by weight. Additions may be made including up to about 0.1% sulfur, up to about 0.14% selenium, about 0.03 to about 0.45% manganese, up to about 0.2% tin and up to about 1% copper. Other additions may also be made including up to about 0.2% molybdenum, up to about 0.2% antimony, up to about 0.02% boron, up to about 1% nickel, up to about 0.2% bismuth, up to about 0.2% phosphorus, up to about 0.1% arsenic, and up to about 0.3% vanadium. Any of the preferred or more preferred ranges could be used singularly or in combination with the broad or preferred ranges.

The steel has a volume resistivity of at least 45 μΩ-cm, at least about 0.01% carbon so that an austenite volume fraction of at least about 20% is present as hot processed and at least one surface of the steel has an isomorphic layer having a thickness of at least about 2% of the thickness of the hot processed steel. The steel is processed using at least one cold reduction stage to a final thickness after which the strip is decarburized. The decarburized steel is coated on at least one surface with an annealing separator coating and is then high temperature annealed to achieve secondary grain growth, develop a forsterite coating and purify the steel.

The addition of chromium lowers the thermodynamic activity of nitrogen which reduces the solubility product of the aluminum nitride used to form the grain growth inhibitor. Accordingly, the steel of the present invention is less prone to premature precipitation of aluminum nitride during and after hot rolling. Further, lower annealing temperatures and/or shorter annealing times may be used while a comparable amount of aluminum nitride prior to cold rolling is provided which is beneficial since manufacturing costs are reduced from lower energy usage and increased annealing productivity.

The hot processed band has an austenite volume fraction of at least 20% and is rapidly cooled prior to cold rolling to final thickness to prevent the formation of pearlite as the primary austenite decomposition product. The chromium-containing steel of the present invention is less prone to transform into martensite and/or retained austenite. Very rapid quenching is needed to ensure that the austenite is transformed into a hard second phase such as retained austenite and/or martensite which is needed for optimum development of the desired cube-one-edge grain orientation and magnetic properties. Chromium up to about 0.60% increases the preferred start-of-quench temperature.

The steel of the present invention realizes improvements in these above mentioned areas without compromising the magnetic properties of the finished product.

BRIEF DESCRIPTION OF THE DRAWINGS

FIG. 1 is a graph illustrating the influence of a low cooling rate (≦15° C./second) prior to final cold rolling on the magnetic permeability at H=796 A/m for high permeability grain oriented electrical steels, FIG. 2 is a graph illustrating the influence of a rapid cooling rate (≧50° C./second) prior to final cold rolling on the magnetic permeability at H=796 A/m for high permeability grain oriented electrical steels of the present invention, and FIG. 3 are photographs at 1× comparing the secondary grain structures of 0.23 mm thick samples of high permeability grain oriented electrical steels made using the low cooling rate of the prior art and the rapid cooling rate of the present invention.

DESCRIPTION OF THE PREFERRED EMBODIMENT

The present invention provides a method for producing a high permeability (greater than 1840) grain oriented electrical steel with high volume resistivity and improved processing characteristics, particularly in decarburization annealing where the method of the present invention allows for significant improvements in productivity. A high permeability electrical steel produced from the method of the present invention provides further advantages over the prior art methods in that the addition of chromium lowers the thermodynamic activity of nitrogen which reduces the solubility product of the aluminum nitride used to form the grain growth inhibitor. The steel of the present invention is less prone to premature aluminum nitride precipitation during and after hot rolling which provides for improved control. Further, lower annealing temperatures and/or shorter annealing times may be used while a comparable amount of aluminum nitride prior to cold rolling is provided which is beneficial since manufacturing costs benefit from lower energy usage and increased productivity in annealing.

The invention teaches a process whereby a high permeability grain oriented electrical steel is produced from a hot processed band of thickness of about 1.5 to about 4 mm. The band, prior to rolling, has a composition comprising about 2.0 to about 4.5% silicon, about 0.1 to about 1.2% chromium, greater than about 0.01% carbon, about 0.01 to about 0.05% aluminum, and balance being essentially iron and residual elements, all percentages by weight. Additions may be made including up to about 0.1% sulfur, up to about 0.14% selenium, about 0.03 to about 0.45% manganese, up to about 0.2% tin and up to about 1% copper. Other additions may also be made including up to about 0.2% molybdenum, up to about 0.2% antimony, up to about 0.02% boron, up to about 1% nickel, up to about 0.2% bismuth, up to about 0.2% phosphorus, up to about 0.1% arsenic, and up to about 0.3% vanadium. Any of the preferred ranges could be used singularly or in combination with the broad or preferred ranges. All of the percentages above and throughout the specification are in weight % and determined prior to cold rolling unless otherwise noted.

A preferred composition will have 2.75-3.75% silicon, greater than 0.25 to about 0.75% chromium, about 0.03 to about 0.06% carbon, about 0.02 to about 0.03% aluminum, about 0.005 to about 0.01% nitrogen, about 0.05 to about 0.15% manganese, about 0.05 to about 0.1% tin, about 0.02 to about 0.03% sulfur and/or selenium, about 0.05 to about 0.25% copper and balance essentially iron and normal residual elements. Any of the preferred ranges could be used singularly or in combination with the broad or preferred ranges. A more preferred composition includes 3.0-3.5% Si. While higher silicon is desired to improve core loss by providing higher volume resistivity, the effect of silicon on the formation and/or stabilization of the ferrite phase and reduction in the austenite volume fraction ($\gamma_{1150° C.}$) must be considered in order to maintain the desired phase balance, microstructural characteristics and mechanical properties.

The hot processed band composition prior to cold rolling comprises greater than about 0.01% carbon, preferably about 0.02 to about 0.08% carbon and more preferably about 0.03 to about 0.06% carbon. A level of carbon below about 0.010% in the hot processed band prior to cold rolling is undesirable because secondary recrystallization becomes unstable and the quality of the cube-on-edge orientation in the product is impaired. High percentages of carbon above about 0.08% are undesirable because the thinning of the isomorphic layer results in weaker secondary grain growth and provides a lower quality cube-on-edge orientation, and results in increased difficulty in obtaining carbon less than 0.003% in decarburization annealing. In the present invention, the amount of carbon needed to be removed during decarburization annealing is reduced, requiring significantly less time for decarburization annealing, significantly improving productivity and reducing manufacturing costs.

The starting steel of the invention is made from a hot processed band. By "hot processed band", it will be understood to mean a continuous length of steel produced using methods such as ingot casting, thick slab casting, thin slab casting, strip casting or other methods of compact strip production using a ferrous melt composition comprising carbon, silicon, chromium, aluminum and nitrogen.

Silicon, chromium and carbon are the primary elements of concern in the method of the present invention, other elements will also affect the amount of austenite and, if present in significant amounts, must be considered. The thickness of the isomorphic layer and austenite volume fraction will also be affected by changes in the carbon content prior to cold rolling to final thickness.

Equation (1) can be used to calculate the effect of common alloying additions on volume resistivity (ρ) of iron.

$$\rho,\mu\Omega\text{-cm}=13+6.25(\%\ Mn)+10.52(\%\ Si)+11.82(\%\ Al)+6.5(\%\ Cr)+14(\%\ P) \quad (1)$$

wherein Mn, Si, Al, Cr and P are the percentages of manganese, silicon, aluminum, chromium and phosphorus, respectively, comprising the composition of the steel. While electrical steels with higher volume resistivity have long been desired; the methods of the prior art typically rely on increasing the percentage of silicon in the alloy. As has been shown in the art, increasing the percentage of silicon will alter the phase balance, that is, the relative proportions of austenite and ferrite, during processing.

Equation (2) below is an expanded form of an equation originally published by Sadayori et al, "Developments of Grain Oriented Si Steel Sheets with Low Iron Loss", Kawasaki Seietsu Giho, vol. 21, No. 3, pp. 93-98, 1989, to calculate the peak austenite volume fraction at 1150° C. ($\gamma_{1150°\ C.}$) in iron containing 3.0-3.6% silicon and 0.030-0.065% carbon.

$$\gamma_{1150°\ C.}=64.8-23(\%\ Si)-61(\%\ Al)+9.89(\%\ Mn+\%\ Ni)+5.06(\%\ Cr+\%\ Ni+\%\ Cu)+694(\%\ C)+347(\%\ N) \quad (2)$$

Phase balance is important in high permeability grain oriented steels that typically have at least about 20% austenite, more typically about 20 to about 50%, and preferably about 30 to about 40%. The provision of an austenite phase during processing serves to control normal grain growth during transcritical process anneals; to enhance aluminum nitride dissolution; and to develop a sharper near-<111> recrystallization texture (transformation with a hard phase such as martensite and/or retained austenite). Normally a higher silicon level requires a higher carbon content to maintain the desired phase balance as shown in Equation (2). Higher percentages of silicon and carbon contribute to poorer physical properties in electrical steels, principally, increased brittleness and increased difficulties in removing carbon during decarburization. The present invention provides excellent magnetic properties and the processing benefits of reduced levels of silicon and carbon by the addition of chromium.

The high permeability grain oriented steel of the present invention may have a chromium content ranging from about 0.1% to about 1.2%, preferably greater than 0.25% to about 0.6% and more preferably greater than 0.3% to about 0.5%. Chromium less than about 1.2% promotes the formation of austenite whereas a chromium level above about 1.2% has adverse effects on decarburization and glass film formation.

The thickness of the isomorphic layer of the hot processed band is important for achieving stable secondary growth. The use of higher silicon, carbon or chromium reduces the thickness of this layer. Typically, the hot processed band is hot rolled and annealed in an oxidizing atmosphere at 1000-1200° C. for a soak time in excess of 30 seconds prior to cold rolling to final thickness. Insufficient carbon removal prior to cold reduction will result in a thinner surface isomorphic layer. In the present invention, the carbon, silicon and chromium levels are adjusted to provide an isomorphic layer thickness conducive to producing stable secondary grain growth with a lessened dependence on carbon removal prior to final cold reduction. Excessive carbon removal will decrease the austenite volume fraction.

An important feature of the present invention is the phase balance of the alloy. Higher silicon levels typically require higher carbon contents to maintain the desired proportions of austenite and ferrite; however, secondary grain growth is adversely affected owing to the reduction of the thickness of the surface isomorphic layer. Using the chromium addition in accordance with the method of the present invention provides a method for providing high volume resistivity and proper proportions of austenite and ferrite without thinning of the surface isomorphic layer.

In the development of the invention, it was determined that the addition of chromium influenced austenite decomposition behavior, making martensite or retained austenite formation during cooling more difficult. A "hard phase", i.e., martensite, retained austenite or bainite, is a desired microstructure characteristic in the hot processed band prior to cold rolling to final thickness for the optimum development of the cube-on-edge orientation in a high permeability grain oriented electrical steel. In the preferred practice of the present invention, higher levels of chromium increase the preferred start-of-quench temperature. Rapid cooling of the starting band is employed prior to cold rolling to final thickness whereby the band is cooled from a temperature greater than 870° C. to below 450° C. at a rate exceeding 30° C. per second and more preferably at a rate exceeding 40° C. per second to prevent decomposition of the austenite into pearlite. Below 450° C., the cooling rate may be reduced slightly. A cooling rate of at least 20° C./second may be used and prevents the tempering of martensite. The hot processed band is cooled at a rate in excess of 30° C. per second to provide martensite and/or retained austenite as the primary austenite decomposition products.

During the conversion of the steel melt into the starting hot processed band, changes in carbon may occur.

It is implicit in the teachings of present invention that the amounts of carbon, silicon and chromium in the steel band prior to cold rolling to final thickness must be sufficient to provide the desired percentage of austenite needed for the development of stable and consistent secondary grain growth.

The thickness of the isomorphic layer on at least one surface of the hot processed band must be at least 2%, and preferably at least 4%, of the total thickness of the hot processed band. The addition of carbon is controlled to provide the desired austenite volume fraction with a surface isomorphic layer thickness of at least 2% in the starting band prior to cold rolling. Preferably, an austenite volume fraction of about 20 to 40% and an isomorphic layer thickness of at least 4% are provided.

The chromium-bearing high permeability grain oriented electrical steel of the present invention contains aluminum in an amount of about 0.01% to about 0.05%, preferably about 0.020 to about 0.030%, and nitrogen in an amount of about 0.005% to about 0.010%, preferably about 0.006 to about 0.008%, in order to provide an aluminum nitride grain growth inhibitor. As noted earlier, the reduced thermodynamic activity of nitrogen in the steel of the present invention is desirable since the solubility of the aluminum nitride is enhanced which provides more flexibility in hot rolling and hot band annealing. However, it is recognized by workers skilled in the art that premature aluminum nitride dissolution in the final anneal may result in unstable secondary grain growth. If the aluminum nitride inhibitor is not sufficiently stable, higher soluble aluminum could be used to readjust the solubility product.

A further benefit of the present invention is that the time required for decarburization annealing is greatly reduced. The alloy balance with the steel of the present invention allows lower percentages of carbon and silicon and higher percentages of chromium to be used. In industrial trials, decarburization annealing productivity increases of 30% have been demonstrated on 0.27 mm thick high permeability grain oriented steel.

The use of higher chromium levels is also beneficial in improving the internal quality of cast slabs by reducing internal ruptures. This is particularly true when copper is present in the steel. The improved ductility may be related to inhibiting the pardoning of copper to the grain boundaries. The solidus temperature is increased which reduces oxidation of the surface when using high slab reheat temperatures.

The production of a high permeability electrical steel of the present invention may include processing steps known in the conventional art, including, but not limited to, one or more cold rolling steps using an annealing treatment between successive steps of cold rolling; interpass aging of the steel during cold rolling; ultra-rapid annealing of the sheet before or during decarburization annealing; infusion of nitrogen into the steel during or after decarburization annealing; the application of a domain refinement treatment such as laser scribing to the finished high permeability grain oriented electrical steel strip to refine the domain wall spacing and further improve the core loss; or the application of a secondary coating onto the finished strip to impart a residual tensile stress in the high permeability grain oriented electrical steel strip and further improve the core loss.

A band composition for nitriding comprises about 2.0 to about 4.5% silicon, greater than 0.1 to about 1.2% chromium, about 0.02 to about 0.045% carbon, about 0.01 to about 0.05% aluminum and the balance being essentially iron and residual elements. The band composition may further include additions of 0.05 to 0.5% Mn, 0.001 to 0.013% N, 0.005 to 0.045% P, 0.005 to 0.3% Sn and up to 0.3% of Sb, As, Bi or Pb alone or in combination. The composition has particular utility for high permeability grain oriented electrical steel which is nitrided during or after the decarburization anneal. The processing of this steel composition provides excellent magnetic permeability measured at 796 A/m which are greater than 1880 permeability and typically above 1900.

Another band composition for nitriding comprises about 2.0 to about 4.5% silicon, about 0.1 to about 1.2% chromium, about 0.01 to 0.03% carbon, about 0.01 to about 0.05% aluminum and balance being essentially iron and residual elements. The band composition may further include additions of 0.05 to 0.5% Mn, 0.001 to 0.013% N, 0.005 to 0.045% P, 0.005 to 0.3% Sn and up to 0.3% of Sb, As, Bi or Pb alone or in combination. The composition has particular utility for high permeability grain oriented electrical steel which is nitrided during or after the decarburization anneal. The processing of this steel composition provides excellent magnetic permeability measured at 796 A/m which are greater than 1840 permeability.

Example 1

Table I summarizes the microstructural characteristics for a range of chromium, silicon and carbon contents for high permeability grain oriented electrical steels.

TABLE I

Summary of Compositions of High Permeability Grain Oriented Electrical Steels Having Volume Resistivity of 504μΩ-cm and Starting Band Thickness of 2.29 mm

| | ID | % Si | Melt % C | % Cr | Y1150° C. | % C before final cold reduction | Isomorphic layer thickness, I (mm) | I/t |
|---|---|---|---|---|---|---|---|---|
| Alloys of Present Invention | A | 3.19 | 0.0610 | 0.20 | 29.7% | 0.0501 | 0.069 | 3.0% |
| | B | 3.13 | 0.0560 | 0.30 | 29.1% | 0.0464 | 0.099 | 4.3% |
| | C | 3.07 | 0.0520 | 0.40 | 29.0% | 0.0436 | 0.121 | 5.3% |
| | D | 3.01 | 0.0485 | 0.50 | 29.2% | 0.0412 | 0.139 | 6.1% |
| | E | 2.94 | 0.0440 | 0.60 | 29.1% | 0.0379 | 0.165 | 7.2% |
| | F | 2.75 | 0.0320 | 0.90 | 29.1% | 0.0294 | 0.231 | 10.1% |
| | G | 2.57 | 0.0240 | 1.20 | 29.9% | 0.0225 | 0.283 | 12.4% |

These exemplary results are for steels having volume resistivity equal to or greater than 50 μΩ-cm which is processed from a starting strip having a thickness of 2.3 mm. Steels A through G are compositions in accordance with the teachings of present invention wherein chromium contents of up to 1.2% are utilized while achieving an austenite volume fraction ($\gamma_{1150° C.}$) of greater than 20% and an isomorphic layer thickness (I/t) of greater than 2% of the thickness of the starting band. These microstructural characteristics are achieved while using a significantly reduced carbon content in the starting band prior to cold rolling.

Example 2

Industrial-scale trial heats of compositions exemplary of the prior art and the method of the present invention, Steels H and I, respectively, in Table II below were melted, continuously cast into slabs having a thickness of about 200 mm, heated to about 1200° C. and provided with a hot reduction to a thickness of about 150 mm, further heated to about 1400° C. and hot rolled to starting band thicknesses of about 2.0 mm and about 2.3 mm. The microstructural characteristics in Table III show that Steels H and I have characteristics conducive to vigorous secondary grain growth.

TABLE II

| Summary of Melt Compositions | | | | | | | | | | | | | | |
|---|---|---|---|---|---|---|---|---|---|---|---|---|---|---|
| | | Chemistry | | | | | | | | | | | | |
| Method | Heat | C | Mn | P | S | Si | Cr | Ni | Mo | Cu | Sn | Ti | Al | N |
| Prior Art | H | 0.066 | 0.079 | 0.005 | 0.024 | 3.27 | 0.10 | 0.11 | 0.034 | 0.15 | 0.07 | 0.0016 | 0.029 | 0.0076 |
| Present Invention | I | 0.054 | 0.078 | 0.005 | 0.025 | 3.14 | 0.33 | 0.1 | 0.034 | 0.15 | 0.07 | 0.0019 | 0.030 | 0.0071 |

The hot rolled bands from Steels H and I were annealed at a temperature of nominally 1150° C., cooled in air to 875-975° C. and finally cooled to 100° C. or less at a rate of less than 15° C. per second or a rate in excess of 50° C. per second. The hot processed bands from Steels H and I were cold rolled directly to final thicknesses of between about 0.20 mm and about 0.28 mm without an intermediate anneal. The final cold rolled strip was decarburization annealed at a temperature of nominally 815° C. using rapid heating from 25° C. to 740° C. at a rate in excess of 500° C. per second in a humidified hydrogen-nitrogen atmosphere having a $H_2O/H_2$ ratio of nominally 0.40-0.45 to reduce the carbon level in the steel to 0.003% or less. The decarburized strip was further provided with a MgO coating and final annealed by heating in a nitrogen-hydrogen atmosphere to a soak temperature of nominally 1200° C. whereupon the strip was soaked for a time of at least 15 hours in 100% dry hydrogen, after which the final annealed strip was scrubbed to remove excess MgO and stress relief annealed at 830° C. for 2 hours in an non-oxidizing nitrogen-hydrogen atmosphere. The samples were subsequently tested for magnetic permeability at H=796 A/m to determine the quality of the cube-on-edge orientation developed and the secondary grain structures were examined.

TABLE III

| Microstructure Characteristics of Heats of Prior Art and Present Invention | | |
|---|---|---|
| Characteristic | H | I |
| Volume Resistivity, p | 49.82 | 50.12 |
| Austenite Volume Fraction, % | 29% | 28% |
| % C before final cold reduction | 0.0527 | 0.0465 |
| Surface Isomorphic Layer Thickness, I (mm) | 0.058 | 0.106 |
| Starting band thickness, t (mm) | 2.29 | 2.29 |
| Solidus Temperature, ° C. | 1471 | 1476 |
| I/t | 2.60% | 4.60% |
| N-as-Al After Hot Rolling | 0.0031 | 0.0021 |
| N-as-Al After Hot Band Annealing and Quenching | 0.0067 | 0.0065 |

FIG. 1 presents the magnetic permeability at 796 A/m versus the final thickness wherein the starting bands of Steels H and I were provided with a cooling rate of 15° C. per second or less. Very good and consistent properties were obtained with Steel H at final thicknesses at or above 0.25 mm. However, the results at final thicknesses below 0.25 mm are inconsistent, showing that the production of a high permeability grain oriented electrical steels using the composition of the present invention would be difficult.

FIG. 2 presents the results for Steels H and I when a cooling rate equal to or greater than 50° C. per second is provided in accordance with the more preferred method of the present invention. This rapid cooling rate provided Steel I with a microstructure more conducive to the development of a high quality cube-on-edge grain orientation. The improved results with Steel I shows that the more preferred method of the present invention can be used to make a produce high permeability grain oriented electrical steel having a final thickness at or below 0.27 mm.

FIG. 3 shows representative secondary grain structures for Steel I which were processed from a starting band having a thickness of 2.3 mm to a final thickness of 0.23 mm to illustrate the effect of the rapid cooling of the starting strip on the stability and completeness of secondary grain growth. As FIG. 3 shows, without the rapid cooling of the preferred method of the present invention, extensive areas of small poorly oriented grains were not consumed during secondary grain growth, resulting in poor magnetic permeability whereas the use of rapid cooling of the preferred method of the present invention provides for complete and consistent secondary grain growth.

Example 3

TABLE IV

| Summary of Composition and Magnetic Properties - 0.27 mm Final Thickness | | | | | | | | | | | |
|---|---|---|---|---|---|---|---|---|---|---|---|
| | Nominal Composition, weight % | | | | | | | 60 Hz Properties | | 50 Hz Properties | |
| Heat | Melt % C | % C before final cold reduction | Si | Cr | Al | N | H10 Perm | P15;60, W/lb | P17;60, W/lb | P15;50, W/kg | P17;50, W/kg |
| J | 0.0649 | 0.0574 | 3.23 | 0.10 | 0.0288 | 0.0074 | 1921 | 0.384 | 0.512 | 0.65 | 0.86 |
| K | 0.0644 | 0.0571 | 3.25 | 0.12 | 0.0289 | 0.0077 | 1927 | 0.388 | 0.516 | 0.65 | 0.87 |
| L | 0.0660 | 0.0584 | 3.22 | 0.10 | 0.0290 | 0.0081 | 1924 | 0.381 | 0.509 | 0.64 | 0.86 |
| M | 0.0658 | 0.0583 | 3.21 | 0.11 | 0.0290 | 0.0074 | 1924 | 0.383 | 0.513 | 0.65 | 0.87 |
| N | 0.0655 | 0.0580 | 3.25 | 0.10 | 0.0304 | 0.0080 | 1927 | 0.376 | 0.500 | 0.63 | 0.84 |
| O | 0.0664 | 0.0590 | 3.21 | 0.14 | 0.0317 | 0.0075 | 1916 | 0.384 | 0.515 | 0.65 | 0.87 |
| P | 0.0545 | 0.0469 | 3.07 | 0.33 | 0.0270 | 0.0074 | 1917 | 0.385 | 0.519 | 0.65 | 0.88 |

TABLE IV-continued

Summary of Composition and Magnetic Properties - 0.27 mm Final Thickness

| | Nominal Composition, weight % | | | | | | | 60 Hz Properties | | 50 Hz Properties | |
|---|---|---|---|---|---|---|---|---|---|---|---|
| Heat | Melt % C | % C before final cold reduction | Si | Cr | Al | N | H10 Perm | P15;60, W/lb | P17;60, W/lb | P15;50, W/kg | P17;50, W/kg |
| Q | 0.0547 | 0.0470 | 3.13 | 0.33 | 0.0282 | 0.0070 | 1919 | 0.385 | 0.517 | 0.65 | 0.87 |
| R | 0.0533 | 0.0459 | 3.09 | 0.33 | 0.0289 | 0.0082 | 1920 | 0.386 | 0.520 | 0.65 | 0.88 |
| S | 0.0544 | 0.0468 | 3.09 | 0.33 | 0.0296 | 0.0074 | 1922 | 0.380 | 0.508 | 0.64 | 0.86 |
| T | 0.0515 | 0.0445 | 3.09 | 0.33 | 0.0303 | 0.0077 | 1925 | 0.381 | 0.509 | 0.64 | 0.86 |
| U | 0.0538 | 0.0463 | 3.09 | 0.33 | 0.0310 | 0.0080 | 1920 | 0.387 | 0.519 | 0.65 | 0.88 |

A series of heats shown in Table IV were made having compositions similar to Steels H and I of Table II. The steels were processed from a starting thickness of 2.3 mm to a final thickness of 0.27 mm. Processing was conducted following the procedure of Example 2 except that the starting bands of Steels J through O were cooled from 870° C. to 100° C. or lower at a rate equal to or less than 15° C. per second whereas Steels P through U were cooled from 870-980° C. to 100° C. or lower at a rate equal to or greater than 50° C. per second. In the decarburization annealing process, Steels J through O were held at or above 815° C. for 195-200 seconds whereas Steels P through U were held for 130-135 seconds. Samples of the steels were tested to verify the carbon removal which distributions are summarized in Table V. The decarburization annealed strip was then provided with a MgO annealing separator coating and final annealed at 1200° C. Afterwards, the steels were scrubbed to remove excess MgO, coated with a secondary coating, thermally flattened at a temperature of 825° C. and laser scribed. Lastly, the steels were tested for core loss using the single sheet test method of ASTM A804.

TABLE V

Summary of Carbon Levels After Decarburization - 0.27 mm Final Thickness

| Steel | Soak Time at or above 815° C. | Production Rate, mpm | Distribution of Residual Carbon 5% | 25% | 50% | 75% | 90% | 95% | 100% |
|---|---|---|---|---|---|---|---|---|---|
| J through O | 200 seconds | 33.5 | 0.0015 | 0.0018 | 0.0021 | 0.0023 | 0.0025 | 0.0027 | 0.0033 |
| P through U | 135 seconds | 44.2 | 0.0017 | 0.0019 | 0.0020 | 0.0022 | 0.0024 | 0.0025 | 0.0028 |

While the magnetic properties shown in Table IV for Steels of J through U are comparable, these results showed that Steels P through U made in accordance with the preferred method of the present invention were substantially easier to decarburize than Steels J through O, allowing for improved productivity and reduced manufacturing cost.

A series of heats were made according to the method of the prior art and the method of the present invention having compositions similar to Steels M and N of Table II. Processing was conducted following the procedures of Example 2 except that during annealing of the starting strip, the steels of the prior art method were cooled from 875-950° C. to 100° C. or lower at a rate equal to or less than 15° C. per second whereas steels of present invention were cooled at a rate in equal to or greater than 50° C. per second. Both steels were cold reduced by 90% from a starting thickness of 2.3 mm to a final thickness of 0.27 mm followed by decarburization annealed to reduce the carbon content of the strip to 0.003% or less.

In the decarburization annealing process, both steels were processed using the procedure of Example 2 wherein the band was heated to 815° C.; however, Steel M was held at or above 815° C. for 195-200 seconds whereas Steel N was held for 130-135 seconds to effect carbon removal. After decarburization annealing, samples were secured to verify the degree of carbon removal which distributions are summarized in Table V. The decarburization annealed strip was then provided with a MgO annealing separator coating and final annealed at 1200° C. Afterwards, the steels were scrubbed to remove excess MgO, coated with a secondary coating, thermally flattened at a temperature of 825° C. and laser scribed in accordance with the method of U.S. Pat. No. 4,456,812. Lastly, the steels were tested for core loss using the single sheet test method of ASTM A804.

While the magnetic properties for steels of both Types M of the prior art and N of the present invention shown in Table IV are comparable, these results shown in Table V show that the steel made in accordance with the method of the present invention was substantially easier to decarburize than the steel made in accordance with the prior art method, allowing for improved productivity and reduced manufacturing cost.

It will be understood various modifications may be made to this invention without departing from the spirit and scope of it. Therefore, the limits of this invention should be determined from the appended claims.

What is claimed is:

1. A method for producing a high permeability grain oriented electrical steel, consisting essentially of the steps of:

providing a strip having a thickness of from about 1.5 to about 4 mm, the strip composition comprising about 2.0 to about 4.5% silicon, greater than 0.25 to about 1.2% chromium, about 0.01 to about 0.08% carbon, about 0.01 to about 0.05% aluminum, the strip having a volume resistivity of at least about 45 μΩ-cm, and an austenite volume fraction (γ1150° C.) of at least about 20%, annealing said strip to provide an isomorphic layer thickness of at least about 2% of the total thickness of the annealed strip, rapidly cooling the annealed strip to ensure that the austenite is transformed into a hard second phase, cold rolling the cooled and annealed strip in one or more stages to provide a cold rolled strip, said cold rolling providing a final reduction of at least 80%, decarburization annealing the cold roll strip sufficiently to prevent magnetic aging, coating at least one surface of the decarburization annealed strip with an annealing separator coating, and final annealing the coated strip to effect secondary grain growth and thereby provide a permeability measured at 796 A/m of at least 1840.

2. The method claimed in claim 1 wherein the composition comprises up to about 0.1% sulfur, up to about 0.14% selenium, about 0.03 to about 0.15% manganese, up to about 0.2% tin, and up to about 1% copper.

3. The method claimed of claim 1 wherein the isomorphic layer has a thickness of at least about 4% on at least one side of said strip.

4. The method claimed in claim 1 wherein the austenite volume is about 20 to about 40%.

5. The method claimed in claim 1 wherein the austenite volume is about 25 to about 35%.

6. The method claimed in claim 1 wherein the cold rolling is done in a single stage and the final cold reduction is at least about 85%.

7. The method claimed of claim 1 wherein a microstructure of the strip prior to the cold rolling to the final thickness consists of a ferrite matrix having more than 1 vol. % of martensite and/or retained austenite and the strip prior to the cold rolling to the final thickness has a carbon content of at least 0.020%.

8. The method claimed of claim 1 wherein the volume resistivity is at least about 50 μΩ-cm.

9. The method claimed of claim 1 wherein the carbon is about 0.03% to about 0.06%.

10. The method of claim 1 wherein the chromium is greater than 0.25% to about 0.75%.

11. The method claimed of claim 1 wherein the chromium is greater than 0.3% to about 0.5%.

12. The method claimed of claim 1 wherein the silicon is about 2.75% to about 3.75%.

13. The method claimed of claim 1 wherein the silicon is about 3.0% to about 3.5%.

14. The method of claim 1 wherein the aluminum is 0.02% to about 0.03%.

15. The method of claim 1 wherein the strip composition further comprises about 0.05% to about 0.09% manganese.

16. The method of claim 1 wherein the strip composition further comprises about 0.05% to about 0.1% tin.

17. The method of claim 1 wherein the strip composition further comprises about 0.02% to about 0.03% sulfur or selenium.

18. The method of claim 1 wherein the strip composition further comprise about 0.05% to about 0.15% copper.

19. The method of claim 1 wherein the carbon is decarburized to a level below about 0.003%.

20. The method of claim 1 wherein the annealing after the decarburizing anneal includes a rapid heating at a rate greater than about 100° C./second.

* * * * *